United States Patent [19]

Leavitt

[11] Patent Number: 4,821,043

[45] Date of Patent: Apr. 11, 1989

[54] STEERABLE WINDOWED ENCLOSURES

[75] Inventor: John N. Leavitt, West Flamborough, Canada

[73] Assignee: Istec Inc., Hamilton, Canada

[21] Appl. No.: 107,438

[22] Filed: Oct. 13, 1987

[30] Foreign Application Priority Data

Oct. 23, 1986 [CA] Canada ..... 521276

[51] Int. Cl.[4] ..... H01Q 3/00

[52] U.S. Cl. ..... 343/765; 343/872; 343/766

[58] Field of Search ..... 343/705, 765, 766, 725, 343/872

[56] References Cited

U.S. PATENT DOCUMENTS

| | | | |
|---|---|---|---|
| 2,475,746 | 7/1949 | Kenyon | 343/766 |
| 2,554,119 | 5/1951 | Perham | 343/765 |
| 3,045,236 | 7/1962 | Colman et al. | 343/705 |
| 3,351,946 | 11/1967 | Verge | 343/765 |
| 3,412,404 | 11/1968 | Bergling | 343/765 |
| 3,638,502 | 2/1972 | Leavitt et al. | 358/109 |
| 3,984,837 | 10/1976 | Tatnall | 343/872 |
| 4,635,067 | 1/1987 | Fitzpatrick | 343/872 |

*Primary Examiner*—William L. Sikes
*Assistant Examiner*—Hoanganh Le
*Attorney, Agent, or Firm*—Rogers & Scott

[57] ABSTRACT

A gyro-stabilized mechanism that is to be carried on a vehicle, such as a helicopter, is provided with a protective enclosure consisting of a dome, usually of glass fiber reinforced plastic. The dome must be provided with a window transparent to the radiation involved, and this must be steered with the mechanism so that they remain in register with one another. Prior art structures employ elongated windows of sufficiently large size to accommodate the tilting and rolling of the mechanism, while pan movements are accommodated by rotating the entire dome. The invention provides a structure employing a small window that can be steered or slaved with the mechanism by rotation of the part of the dome including the window relative to the other part, which has the pan or yaw rotation motor connected to it. This rotation between the dome parts takes place in a skew plane disposed at as small a skew angle to the vertical as is possible, the compensation for the resulting transverse movement of the window being effected by a programmed rotation of the dome about the pan axis. Optically flat glass can then be used for the window, it can be coated to reduce reflections, etc, and it can also be wiped in operation to remove moisture. A broadcast antenna can be mounted on the part of the dome out of the line-of-sight of the apparatus.

12 Claims, 8 Drawing Sheets

STEERABLE WINDOWED ENCLOSURES

FIELD OF THE INVENTION

This invention is concerned with improvements in or relating to steerable windowed enclosures, such as are employed to enclose a gyro-stabilized mechanism which is mounted within the enclosure and is employed to stabilize the line-of-sight of a device, such as a photoelectric sensor, television camera, movie camera, infrared imager, or directional antenna, mounted on the stabilized mechanism.

REVIEW OF THE PRIOR ART

Such gyro-stabilized mechanisms have now become well known and a particularly successful example of such apparatus is that produced and sold by Istec Limited, of Hamilton, Ontario, Canada, under the name "Wescam". The Wescam apparatus enables a device such as a photoelectric sensor, camera, or radio antenna to be mounted on a vehicle, such as a truck, dirigible, or an aircraft, particularly a helicopter, or to be suspended from a boom or cable, and will stabilize the line-of-sight of the device to the extent that it is able to deliver a sharp, steady image of the scene being viewed with exceptional stability, as though the device were instead mounted on an earth-based tripod. It is becoming more and more recognized that such equipment has many valuable applications in addition to its already well established role with television and movie cameras, permitting long distance viewing of events with the picture stability that is necessary for broadcast or security purposes.

Owing to the expensive and complex nature of the apparatus, it is essential that it be enclosed in order to protect it from dust, weather, etc. Since one of the most common applications involves mounting the apparatus on an aircraft, this enclosure is usually of spherical form, so as to present the minimum windage and drag in all directions of motion through the air of the aircraft. The enclosure must then be provided with a window of sufficient extent for the equipment within it to be traversed over the full range that is required in practice. It is relatively easy to mount the enclosure to rotate with the apparatus about a single axis and the window is then made of sufficient width transverse to the plane of rotation to provide for the necessary field of view in azimuth or pan. However, the window must then also extend over an arc of about 135°, which will permit the apparatus to be tilted, for example, from an attitude pointing vertically downward to one in which it is tilted approximately 30° above the horizontal plane, irrespective of course of any difference in attitude of the supporting aircraft from straight and level.

The variation in thickness of the relatively large window that must therefore be employed severely limits the resolution of an optical system that is employed in the mounted apparatus, and can also cause geometric distortion in the image. Other difficulties are encountered resulting from unwanted reflections and multiple reflections from the window surfaces. These are variously seen as flare, highlights, loss of contrast on the image, etc. The random material must be transparent to the energy being received or radiated and in order to try to avoid such limitations, the window that has been employed consists of a thin film of acrylic or mylar plastic material, usually of not more than 1.5 mm thickness (and as thin as 0.2 mm), in a conformal conical shape mounted in the elongated window slit in the spherical enclosure. Such thin films, while optically adequate up to certain limits, are subject to deformation and consequent wrinkled reflections, limited life, and difficulty in cleaning, owing to its fragility and the fact that cleaning may produce static electrical charges causing clinging of dust to the surface. Since some of these difficulties stem from the necessity for the window to be curved, these difficulties can be avoided, or at least mitigated, if the window is of small size, since it then becomes economic to use optically flat glossy materials whose surface finish, reflectivity and uniformity of thickness can be controlled to any desired degree. Moreover, it is possible to use expensive special materials, such as those which give good transmission of infrared radiation. With such a small window, less surface area is exposed for damage and dirt accumulation, and many of the materials that are available for such a window permit it to be wiped or spun to eliminate the collection of moisture thereon. However, such a small window of course severely limits the degree of movement of the mechanism mounted within the enclosure, unless the window can also be steered in conformity with the movement of the gyro-stabilized mechanism. This presents unexpected difficulties which are overcome by the present invention.

DEFINITION OF THE INVENTION

Thus, it is a principal object of the invention to provide a new steerable windowed enclosure for a gyro-stabilized mechanism mounted within the enclosure and including a relatively small window through which the gyro-stabilized mechanism can view the exterior, and which can be moved in conformity with the controlled movements of the mechanism so that they remain registered with one another.

In accordance with the present invention there is provided a steerable windowed enclosure for a gyro-stabilized mechanism mounted within the enclosure comprising:

means for mounting the enclosure on a support;

means for rotating the enclosure relative to the support about a first axis to steer the window for movement in a respective first plane;

the enclosure comprising a first part to which the mounting means are attached, and a second movable part including the window mounted for movement relative to the first part in a skew plane inclined to said first axis and having a second skew axis perpendicular thereto;

means for rotating the two enclosure parts relative to one another about the said second skew axis; and means for controlling the rotating means such that rotation of the two enclosure parts about the second skew axis is compensated as required by rotation of the enclosure about the first axis to compensate for the inclination between the said first axis and the skew plane.

DESCRIPTION OF THE DRAWINGS

Particular preferred embodiments of the invention will now be described, by way of example, with reference to the accompanying diagrammatic drawings, wherein.

DETAILED DESCRIPTION OF THE EMBODIMENTS

Figure 1:
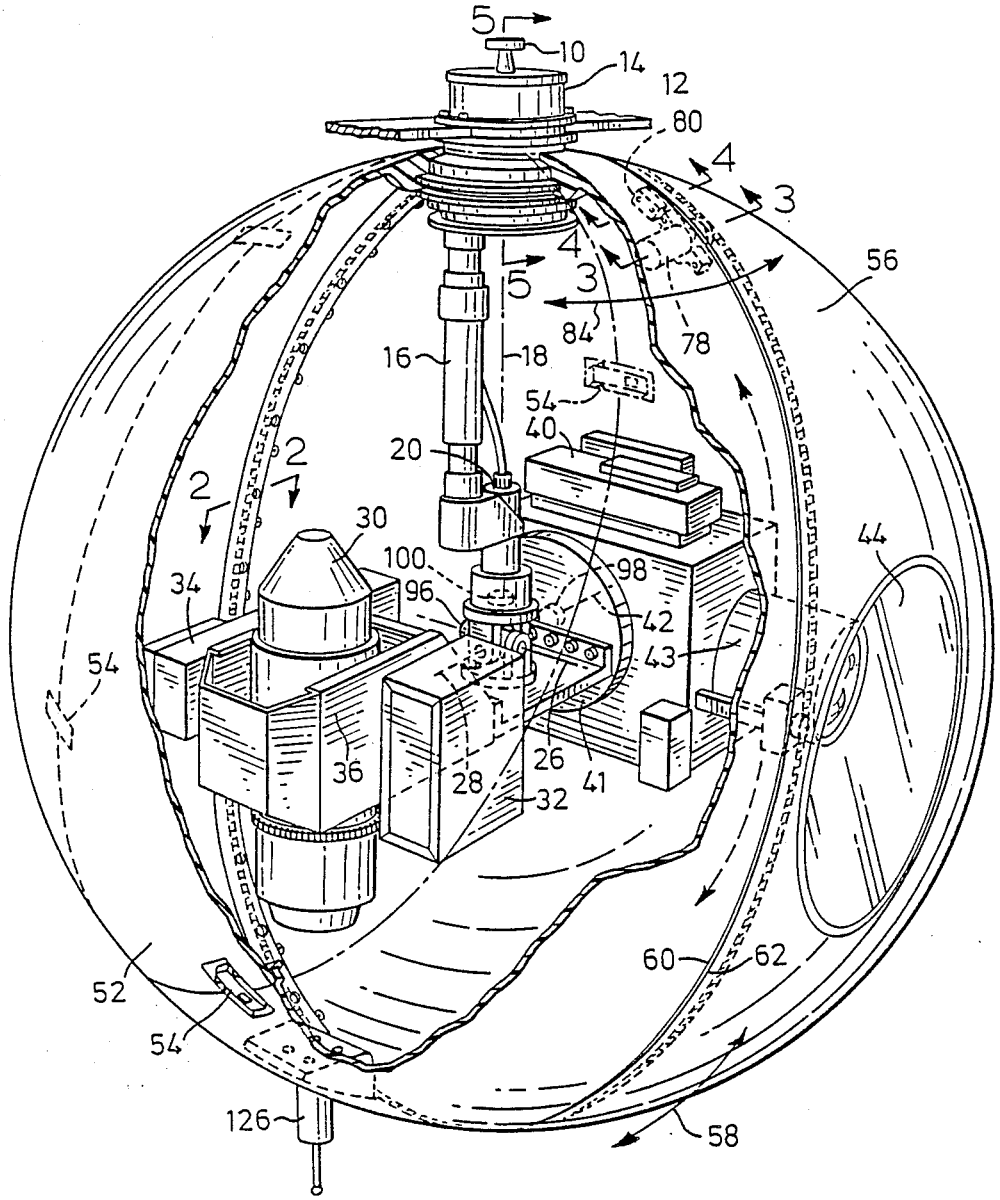
FIG. 1 is a general perspective view of the enclosure, a front part of the side wall being cut away, and parts being shown in broken lines where they are otherwise concealed.
Figure 2:
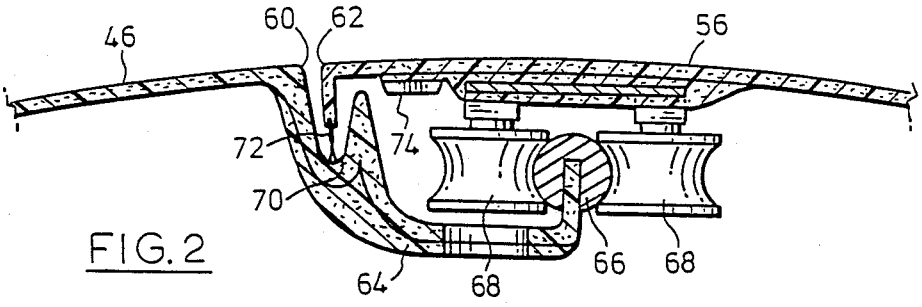
FIGS. 2, 3, 4 and 5 are cross-sections taken respectively on the lines 2—2, 3—3, 4—4 and 5—5 of FIG. 1 to illustrate details of the joint between the two relatively movable parts of the enclosure.
Figure 3:
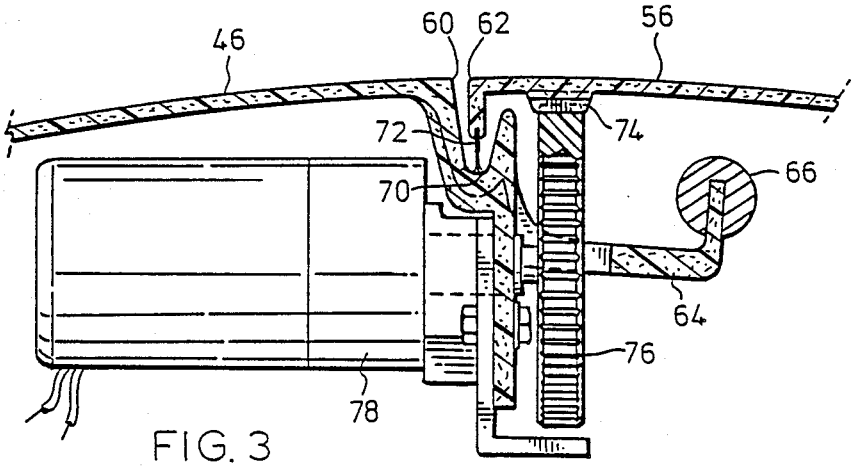
Figure 4:
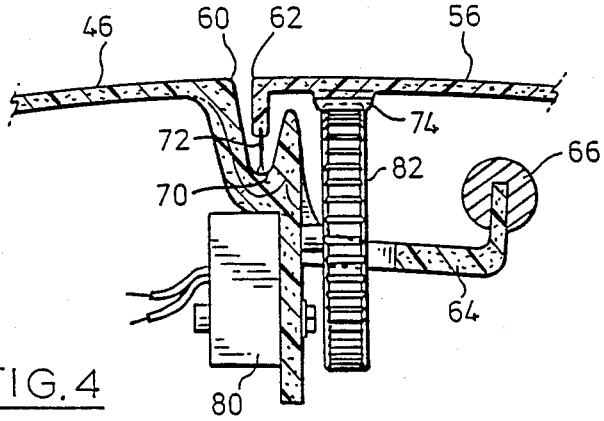

The invention will now be particularly described in connection with a steerable windowed spherical enclosure particularly intended for applications where the enclosure is subjected to high winds, such as being carried by a helicopter, or suspended from a cable or a boom arm. A spherical shape is therefore chosen to minimize air resistance in all relative directions of movement. However, in other applications, a spherical shape may not be necessary. In addition, in this embodiment the gyro-stabilized mechanism mounted within the enclosure comprises a television camera, but in other embodiments can consist of any other form of sensor or transmitter for electromagnetic radiation, including radio frequency radiation, as well as optical and infra-red radiation.

It should be noted that there is the possibility of confusion in the nomenclature employed in the two different disciplines which must be noted. Thus, an aircraft is said to "pitch" when it rotates about a horizontal axis in a vertical plane extending lengthwise of the aircraft, it "rolls" when it rotates about a horizontal axis in a plane transverse to the length of the aircraft, and it "yaws" when it rotates in a horizontal plane about a vertical axis. On the other hand, a movie or television camera "pans" when it rotates about a vertical axis in a horizontal plane, and "tilts" when it rotates about an axis in that horizontal plane, and to distinguish between them it is called the "pix tilt" axis. The roll axis of the camera corresponds to that axis in the horizontal plane and normal to the pix tilt axis, and to distinguish the two the camera axis is called the "pix roll" axis. The axis along which the camera lens or the equivalent sensor is aligned is called the "line-of-sight" axis (and is coincident with the pix roll axis). The gyro-stabilizer also has its own set of axes and when necessary these are referred to as the "gyro-yaw" axis, the "gyro-pitch" axis and the "gyro-roll" axis, which correspond generally to the vehicle axes, but constitute an independent set of axes, not necessarily corresponding to the others.

For convenience, in the following description of the embodiment it is assumed that the entire apparatus is in a "neutral" position in which the dome is suspended vertically from an aircraft which itself is straight and level, with the sensor line-of-sight also level in the horizontal plane, so that the respective axes of the aircraft, the mounted mechanism and the gyro-stabilizer are parallel to one another.

The mechanism with which the dome enclosure is associated consists of a member 10 by which it is attached to a vehicle, such as a helicopter. A supplementary support structure 12 is provided for handling purposes. The member 10 is attached to a dome support structure indicated by 14 and shown in more detail in FIG. 5. A mechanism support pedestal shaft 16 extends vertically downward from the member 14 offset from vertical axis 18 thereof and is cranked part way along its length so that its lower end is coaxial with the axis 18. The arm is provided at the cranked part with a plug 20 for the electrical connections that are required. The shaft 16 terminates at its lower end in a 3 axis cardan joint 22 to the lower end of which is attached a pan platform 24 which in the described orientation is horizontal. The purpose of the cardan joint is primarily to isolate the mounted mechanism from the angular motion of the pedestal shaft 16, and to this end it gives freedom of movement of the pan platform 24 relative to the shaft 16 about two orthogonol axes 26 and 28, so that the platform can pan about axis 18, pix roll about axis 26 and pix tilt about axis 28. The platform has mounted at one end thereof a gyro-stabilizer mechanism 30 of known type, such as that disclosed in our U.S. Pat. No. 3,638,502, the disclosure of which is incorporated herein by this reference. Steering electronics 32 and acceleration dampers 34 are also mounted on the same frame 36 that supports the gyro-stabilizer. A television camera 38 is mounted on the pan platform on the opposite side of the vertical axis 18, and exactly counterbalances the gyro-stabilizing unit 30 and its associated components about both cardan axes 26 and 28. The camera is provided with a lens compensator 40 which moves a weight automatically to adjust the balance of the camera as the relatively heavy lens elements move to focus the camera and change the effective focal length (zoom). The camera lens and associated components are rigidly mounted to a structure defined as the "tilt platform", constituted by the pan platform, the gyroscopic stabilizer and a tilt joint member 41, which is supported from the pan platform 24 for rotation about an independent horizontal axis provided by the tilt joint member 41 parallel to axis 28, but not necessarily coincident with it. The camera is thereby mounted for tilt rotation about the horizontal axis 28 so as to be pix tilted as described above independently of the pan platform.

The entire mechanism is enclosed in a spherical dome enclosure or shell that is mounted at its top end on the member 14 which is driven for rotation by a servo motor 127 therein via pinion 128 and ring gear 130 so as to be rotatable with the structure. The lens 42 of the camera views the exterior through a window 44, and in the prior art structure the necessary registration between the window and the lens is maintained by rotating them with one another in the horizontal plane about the axis 18, while the window has a vertically elongated slotted shape, extending over at least 135° of extent of the sphere, with the attendant difficulties described above. The structure so far described is already known and is intended to overcome the uneven roughness of motion in mobile vehicles, whereby images picked up by the sensor or camera mounted on these moving platforms would otherwise suffer from angular motion about three axes mutually at right angles, as well as vibration in all three directions. The stabilized platform provided by the mechanism is able to hold the camera steady as though tripod mounted on the ground, despite these movements and vibrations of the vehicle.

It will be noted that the vertically slaved or steerable window 44, indicated in the drawings by the acronym VSW, is quite small and is circular. For example, in an embodiment in which the spherical dome has a diameter of 80 cm (32 in.), the window has a diameter of 35 cm (14 in.). A window of this relatively small size can be of strengthened optical glass whose surfaces are flat to about $\pm 5-7.5\times 10^{-4}$ cm ($\pm 2-3\times 10^{-4}$ in.), these surfaces being coated (e.g. with magnesium fluoride) to reduce internal reflection and consequent flare. In this embodiment the window is a flat plate, but in this and the smaller sizes it can be spherical of the same diameter as the dome to further reduce asymmetric aerodynamic drag which might otherwise be introduced. An external wiper mechanism can be provided to keep the exterior surface clear of moisture, or the window can be mounted to spin against a fixed wiper, or to spin fluids clear of the surface by centrifugal force; structures for this purpose are well known, for example, in the art of aircraft or naval construction and need not be specifically described herein. In this embodiment the window is made relatively large in diameter for flexibility as to the type of mechanism that is mounted therein; its diameter is dictated mainly by the effective optical aperture at the dome circumference of the stabilized mechanism, and in an embodiment dedicated to a specific type of apparatus it may be possible to make the window much smaller. This is particularly advantageous if the window needs to be of a relatively costly material, such as may be required to obtain a specific radiation transmission characteristic (e.g. infra-red).

The dome is divided in a skewed sector plane into a first, larger portion 46 that is "fixed" only in the sense that it is fixed to the dome support structure 14 and is rotated thereby by means of the drive motor therein, the portion 46 being fastened for this purpose to driven ring 48 (FIG. 5) by the motor gearhead contained in the housing 14, the ring being supported by a bearing 50. In this embodiment, this portion is provided with a removable inspection portion 52 fastened to the remainder by snap latches 54. The second hemispherical portion 56 of the dome including the window 44 is mounted by the first portion for rotation relative thereto in the directions indicated by the arrows 58 about an axis which is perpendicular to the said skewed plane. It will be seen from consideration of FIG. 1 that the said skewed plane is circular and is effectively delineated in that it lies at the mutual junction between the two circular edges 60 and 62 respectively of the first and second dome segments 46 and 56. It is also difficult to show the skew axis about which the smaller segment 56 rotates relative to the larger segment, but it will be apparent to those skilled in the art that it originates at the geometric centre of the circular skewed plane and in this embodiment will intersect the axis 18 at some point close to the cardan joint 22.

Referring now also to FIGS. 2–5, the two sectors are arranged for such mutual rotation by an annular extension 64 of the first sector 46 which extends into the interior of the second sector and carries at its free end a circular track 66 of circular transverse cross-section. The track is engaged by the required number of circumferentially spaced pairs of rollers 68 (24 pairs in this embodiment), each pair engaging the track circumferentially oppositely to one another, their peripheries being shaped to conform to the track cross-section, so that the track is securely held between them and the two parts can rotate relative to one another through 360° without binding. The extension 64 includes a circumferentially grooved portion 70, into which protrudes a flange carrying a brush seal 72, in turn carried by the portion 56, to seal the joint between them. The mechanical drive between the two sectors is constituted by a circular toothed rack member 74 mounted on the inner wall of the second sector 56 and engaged by a toothed pinion 76 (FIG. 3) driven by a VSW servo motor 78. The relative positions of the two sectors at any time is detected by a read-out potentiometer 80 (FIG. 4), which is connected by an internal gear reduction drive to another toothed pinion 82 also engaged with the rack 74, so that the position of the potentiometer arm and its value corresponds to the said relative position.

The circular skew plane at the junction of edges 60 and 62 intersects a corresponding plane containing the axis 18 along a line which also passes through the axis 18, and the two planes together delineate an angle between them designated as the skew angle. As the two sectors rotate relative to one another the window 44 also moves transversely relative to the enclosed mechanism, so that they will move out of register with one another. It has been found that by providing a correction signal derived from the read-out potentiometer 80, to the existing drive motor 127 for rotating the entire dome, the same drive as is used for rotating the mechanism support pedestal may be made to provide for the transverse rotation required for this correction, and by careful choice of the said skew angle, it is possible to compensate completely adequately for this transverse motion by the expedient of rotating the entire dome and pedestal about the axis 18, as indicated by the arrows 84 in FIG. 1. Moreover, with a suitable choice it is found that the relation required to correlate the two movements is sufficiently simple that relatively simple analogue circuits are required for the necessary simultaneous control of the two motors 78 and 127.

Figure 6:
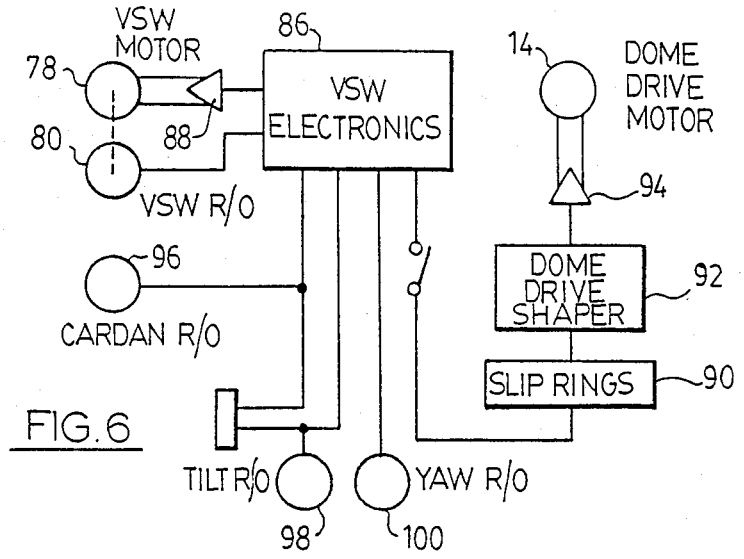
FIG. 6 is a general circuit diagram of the electrical portion of the apparatus.

FIG. 6 shows schematically the general arrangement that is required for the drive circuits. A circuit 86 designated the VSW electronics circuit controls the VSW servo drive motor 78 via an amplifier 88, and controls the dome drive motor 127 via slip rings 90, a shaper circuit 92 (which provides lead and lag terms to the drive as required) and amplifier 94. The circuit 86 is supplied with information as to the relative orientations of the two dome segments by VSW read-out (RO) potentiometer 80, and since the drive of the stabilized mechanism is now independent of the drive for the entire dome, it is supplied with the necessary information as to the attitude of the stabilized mechanism from cardan read-out potentiometer 96, tilt read-out potentiometer 98 and yaw read-out potentiometer 100; FIG. 1 shows the location of these read-out potentiometers in the apparatus.

Figure 7:
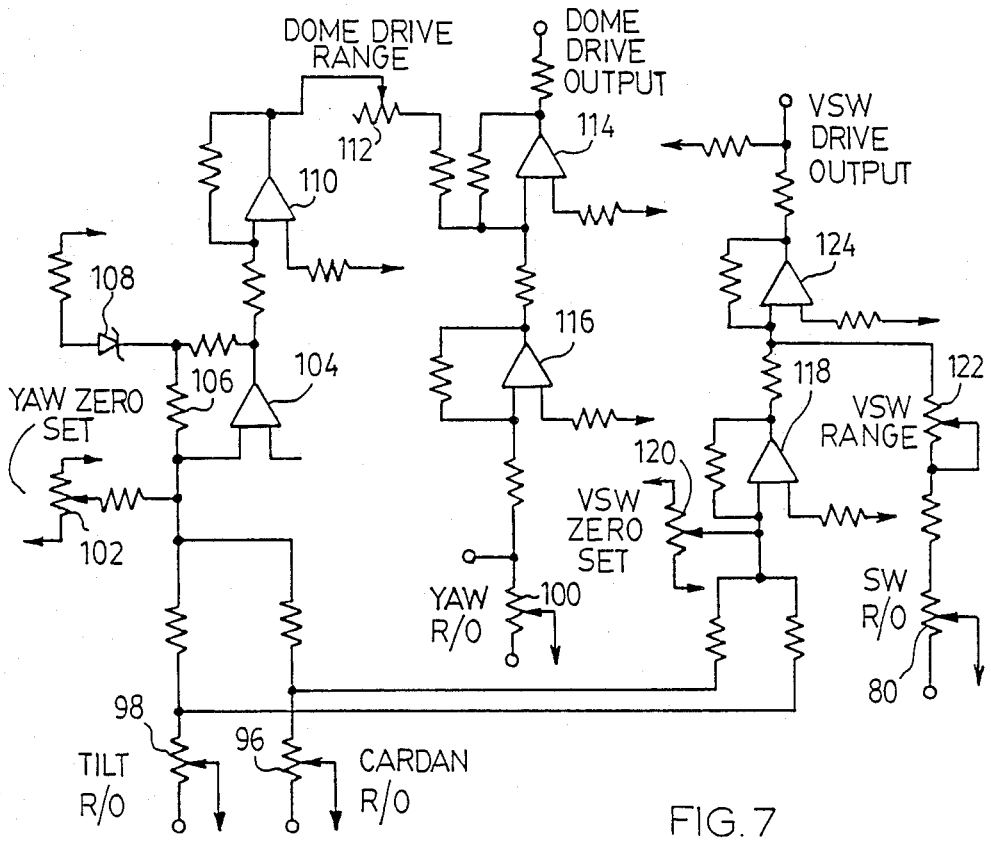
FIG. 7 is a diagram of an electronic circuit employed in the general circuit of FIG. 6.

FIG. 7 shows more specifically the electronic circuit 86, components that are not necessary for description of the circuit being omitted, as is now customary. The values from tilt read-out potentiometer 98 and cardan read-out potentiometer 96 are summed and are offset as necessary by the yaw zero set potentiometer 102. This value is fed to amplifier 104 which is back biased by resistor 106 which is in turn shunted by a zener diode 108 that provides the necessary correction characteristic to the amplifier output, as will be described below in connection with FIGS. 8*a*–8*d*. The output of amplifier 104 is fed to amplifier 110 and via a gain control resistor 112 to the main dome drive amplifier 114. The value of the yaw read-out potentiometer 100 is not shaped, but is summed directly to the dome drive amplifier 114 via its own intermediate amplifier 116. The tilt and cardan read-out signals are also summed into the input of an amplifier 118 in the slave window drive chain, with an offset if required for VSW zero set potentiometer 120, the yaw value not being required since this is taken care of inherently by rotation of the dome. The output of VSW read-out potentiometer 80 is offset as necessary by the VSW range potentiometer 122 and summed with the output of amplifier 118 into the input of main VSW drive amplifier 124.

Figure 8A:
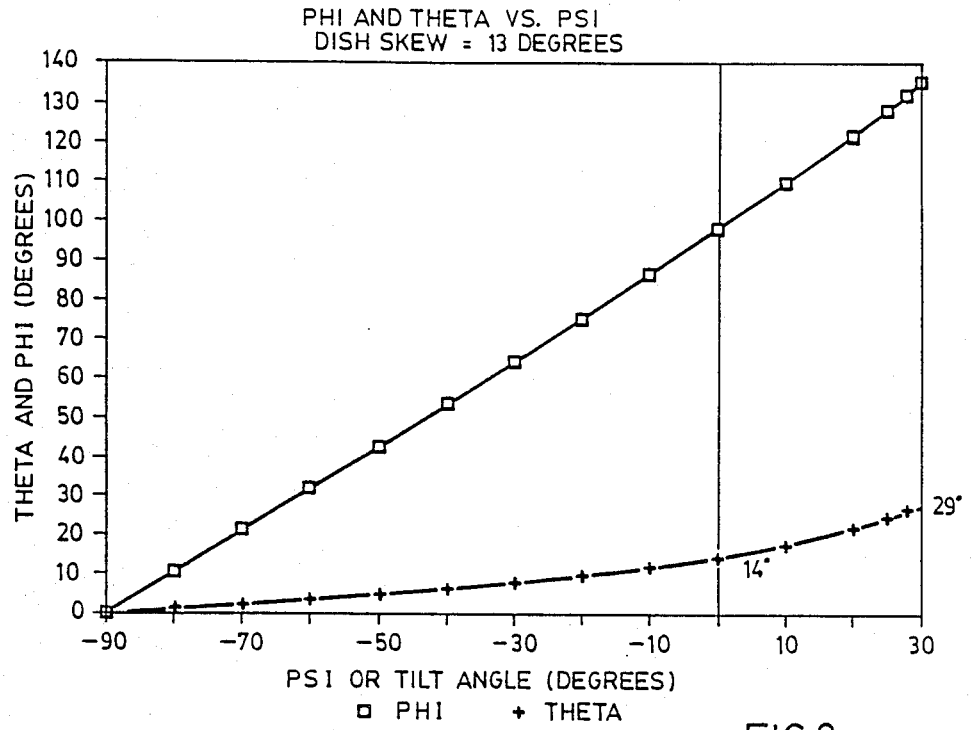
FIGS. 8*a*, 8*b*, 8*c* and 8*d* are plots for different skew angles of the relation required between movement of the enclosure window and the line-of-sight of the mechanism to ensure registry between them.
Figure 8B:
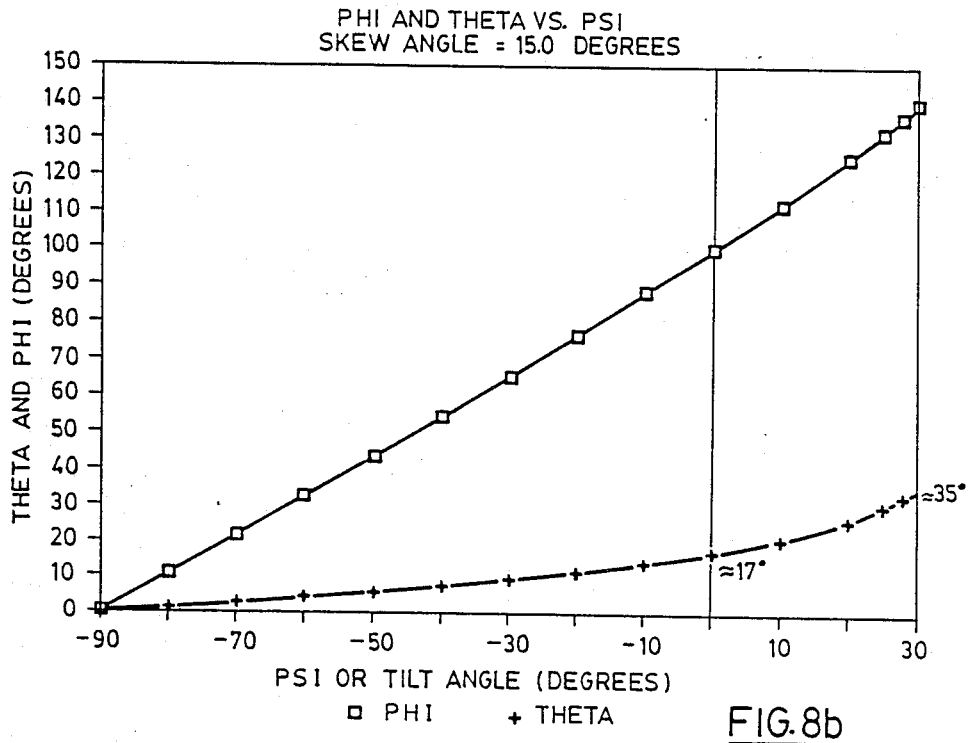
Figure 8C:
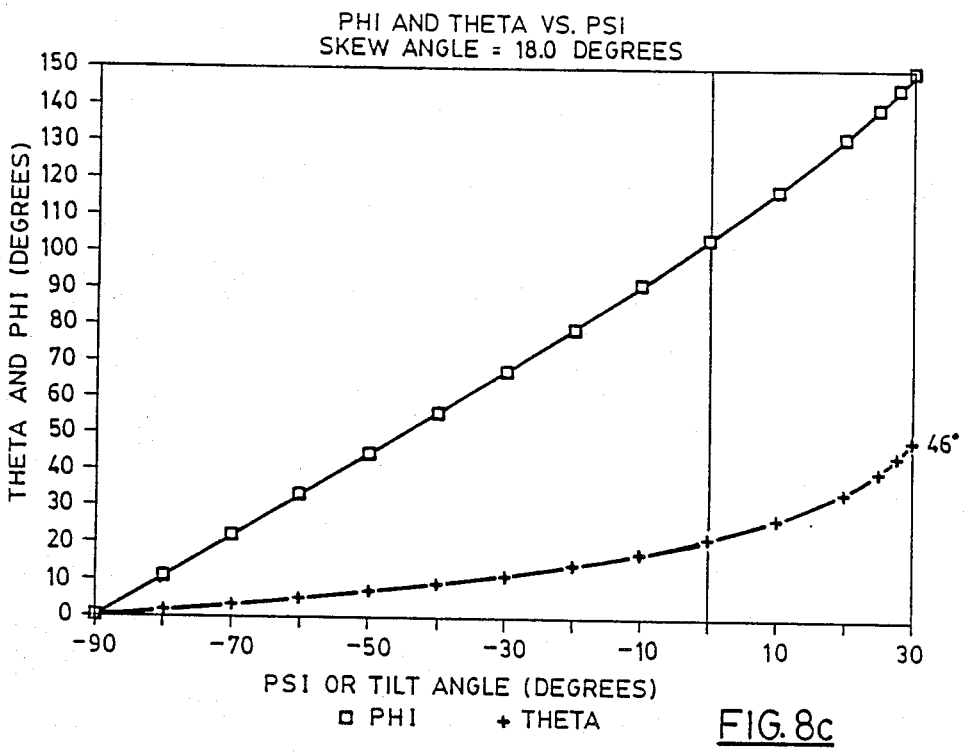
Figure 8D:
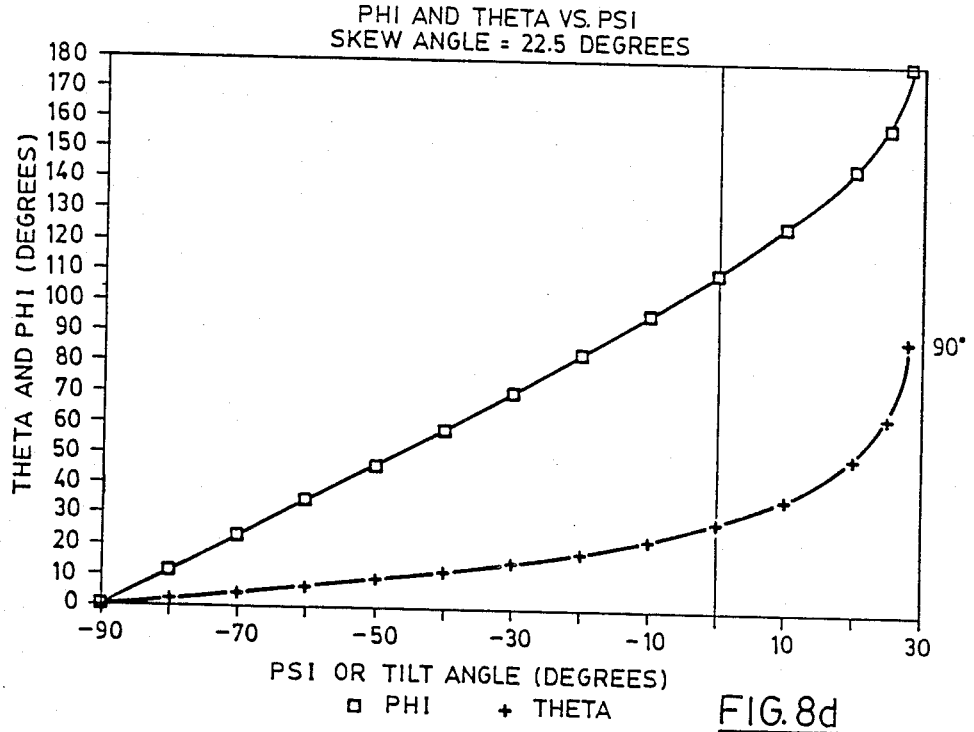

Referring now to FIGS. 8*a*–8*d*, FIG. 8*a* shows the relation that is required between the two drives when the skew angle, as specified above, is 13°. The value of Psi is the line-of-sight angle from the horizontal of the stabilized apparatus, and it will be seen that the value of the angle Phi, which is the angle required for rotation of the vertically slaved window about the skew axis, is virtually in a linear relationship, while the angle theta, which is the angle that the entire dome must be rotated about its vertical axis to compensate as described above, increases in a non-linear but readily correctible manner with the analogue circuitry described. FIG. 8*b* shows that the correction required with a skew angle of 15° is virtually the same as that for 13°, e.g. the angle theta has increased to 35° instead of 30° for 30° of Psi. FIG. 8*c* shows considerably increased problem when the skew angle is now 18°, and the angle theta has increased to 45°, while FIG. 8*d* shows that with a skew angle of only 22.5° the angle theta has become almost asymptotic with a value of 90°. It will be understood that the skew angle preferably is as small as possible, especially as the dome is reduced in diameter, so as to provide as much space as possible at the upper pole of the dome between the drive motor and the sector joint.

A particularly advantageous feature of the invention is illustrated by FIG. 1 in that it is possible to mount a broadcast transmitting antenna structure 126 on the first or "fixed" part of the dome, which will thereafter maintain a relatively constant orientation to the ground, apart of course from changes of attitude caused by the supporting vehicle, and without the possibility of interference between its radiation pattern and the stabilized mechanism on the dome itself. Other equivalent structures such as identifying reflectors or transmitters can also be mouted in this way.

This mounting location resolves a problem that is otherwise encountered because the required antenna radiation pattern is omnidirectional for optimum reception by the ground station, and there is the possibility of interference between the pattern and the body, or between the field of view containing the antenna. Thus, the two elements are now disposed in fixed spatial relationship such that this cannot occur, since the antenna and the line-of-sight rotate in unison with one another.

Figures 5, 9:
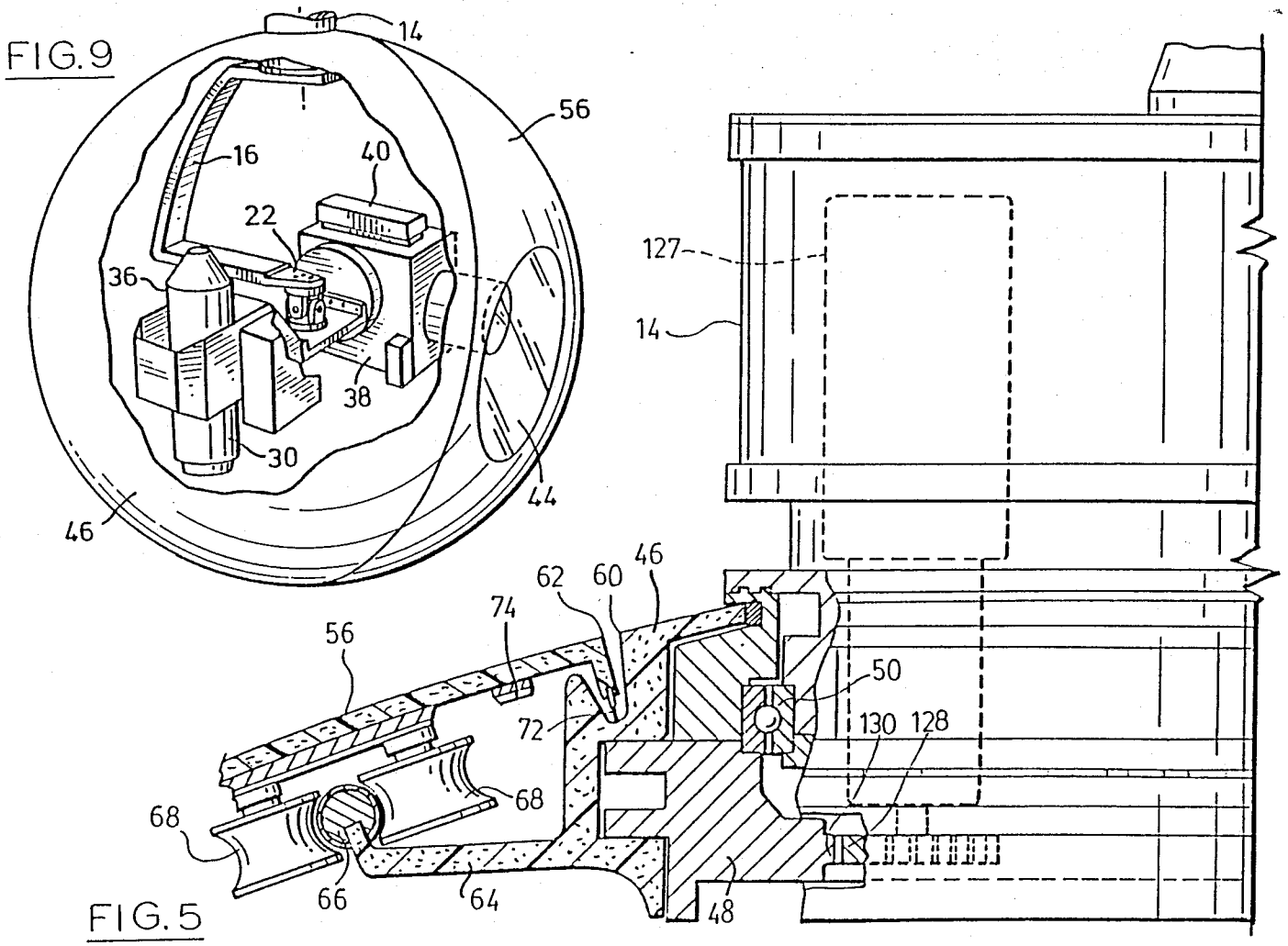
FIG. 9 is a diagrammatic view of a second embodiment showing a preferred form of the supporting arm for the apparatus within the enclosure.

FIG. 9 shows an alternative embodiment in which the support arm 16 is more highly offset, so that its intermediate portion closely follows the interior contour of the dome; the vehicle is now able to pitch and roll to greater angles because of the increased clearance from the pedestal. Also, this greater offset allows reduced spacing between the gyro-stabilizer and the camera, potentially reducing the overall size of the entire assembly.

Figure 11:
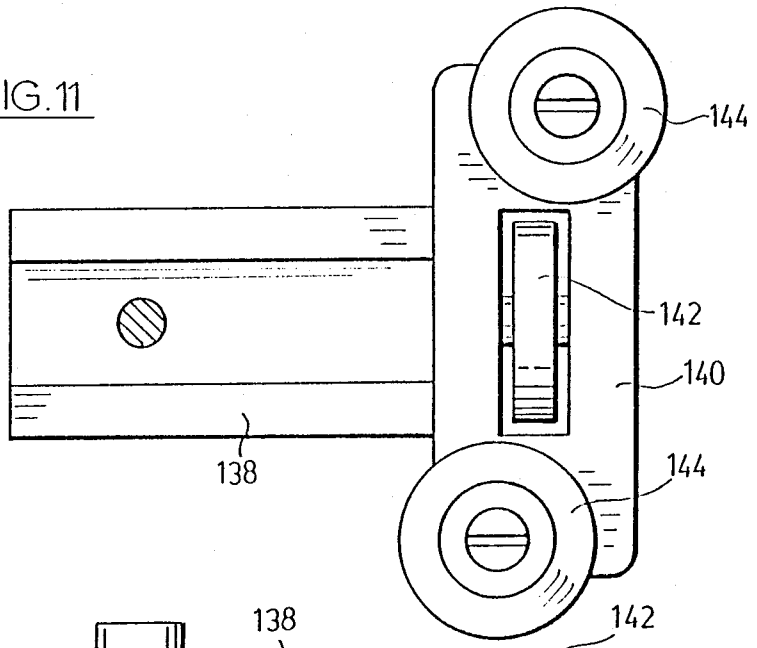
FIG. 11 is a plan view from above of a connecting dolly employed in the joint of FIG. 10.
Figure 10:
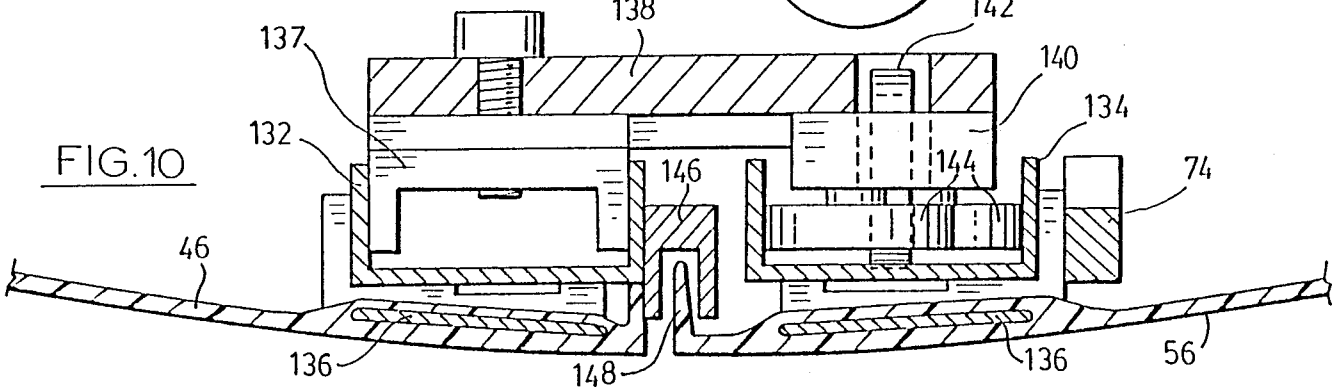
FIG. 10 is a cross-section similar to FIG. 2 to illustrate details of a different joint structure between the parts of the enclosure.

In the bearing structure illustrated by FIGS. 10 and 11 a matched pair of channel members 132 and 134 are mounted on the respective edges 60 and 62 that have been reinforced by inserts 136, the mounting being such that the channel floors are coplanar and the channel uprights are parallel. The channel 132 on the stationary side 46 has fixed therein a plurality of equally circumferentially-spaced support members 136 to each of which is attached a support arm 138 that extends across the junction between the channel. Each arm in turn has attached thereto a respective bearing dolly 140, which has one bearing wheel 142 acting radially, in engagement with the floor of the respective channel, and two bearing wheels 144 acting circumferentially and engaging opposite inner walls of the channel uprights, so that the dome parts can rotate relatively to one another, as required. The channel member 146 providing a circumferential groove is fixed to the stationary channel 132, while a flange 148 on the edge 62 of moving part 56 protrudes into the groove to provide a seal. Circular toothed rack member 74 is provided fastened to the channel 134 and is operative with a meshing pinion (not shown) as in the first-described embodiment.

Figure 12:
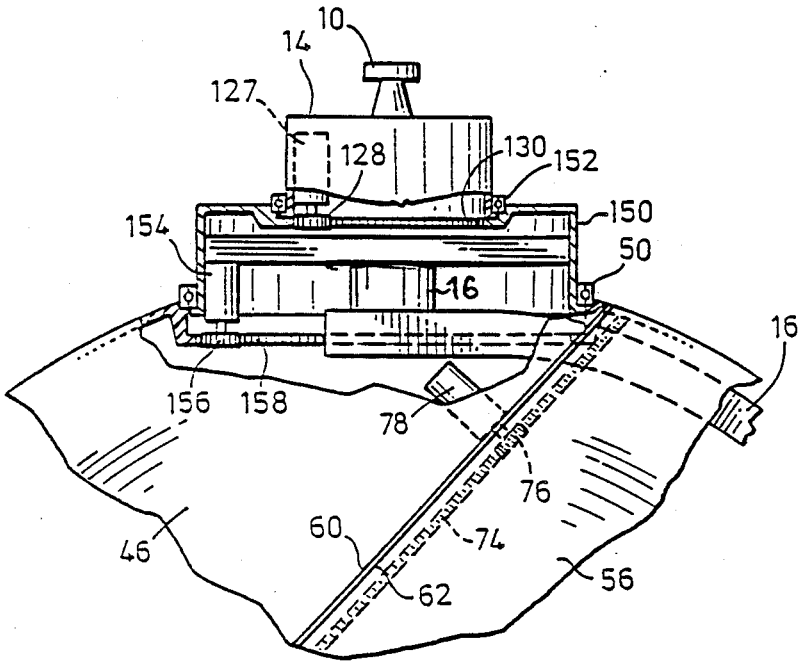
FIG. 12 is a diagrammatic view of a third embodiment employing an additional motor.

In the embodiment illustrated by FIG. 12 an intermediate support member 150 is interposed between the dome support member 14 and the "fixed" dome part 46, mounted for rotation relative thereto by an additional bearing 152 providing an axis of rotation for the dome coincident with the axis 18; the pedestal 16 is mounted by this additional support member and consequently the dome and the pedestal 16 may be rotated independently of one another by independent driving motors, namely the motor 127 and an additional motor 154 having a pinion 156 engaged with a rack 158 on the dome part 46. This permits independent rotation of the pedestal to clear the supported mechanism so as to permit the required alignment between the window and the line-of-sight. In such cases the control circuit is modified to provide a modified incremental drive to the motor 154 only in order to provide the necessary compensation about the axis 18. Such an embodiment may be made smaller, but has the disadvantage of the additional motor, bearing, etc., and in addition makes it difficult to obtain the smaller skew angles between the dome parts 46 and 56.

I claim:

1. A steerable enclosure for a gyro-stabilized mechanism mounted within the enclosure, the enclosure having a window therein through which there is established a line-of-sight from the enclosure interior to the exterior, comprising:

mounting means for mounting the enclosure on a support therefor and including first rotating means for rotating the enclosure relative to the support about a first axis to steer the window for movement in a respective first plane;

the enclosure comprising a first enclosure part to which the mounting means are attached, and a second movable enclosure part including the window mounted for movement relative to the first part in a skew plane at an incline angle to said first axis and having a second skew axis perpendicular thereto;

second rotating means operatively connected between the two enclosure parts for rotating them relative to one another about the said second skew axis; and means for controlling the said first and second rotating means such that rotation of the two enclosure parts about the second skew axis by the second rotating means is compensated as required by rotation of the enclosure by the first rotating means about the first axis to compensate for the said incline angle between the said first axis and the skew plane.

2. An enclosure as claimed in claim 1, wherein the first part of the enclosure is the major part and the second part of the enclosure is the minor part.

3. An enclosure as claimed in claim 1, wherein the said second skew axis intersects the said first axis.

4. An enclosure as claimed in any one of claims 1 to 3, wherein the first and second enclosure parts are connected to one another by a circular track mounted on one part and engaged by a circumferentially spaced plurality of pairs of rollers mounted on the other part, each pair of rollers embracing the track.

5. An enclosure as claimed in any one of claims 1 to 3, wherein the said second rotating means for rotating the first and second enclosure parts relative to one another comprise a toothed circular rack mounted on one part and a servo motor driving a toothed pinion engaged with the rack, the servo motor being mounted on the other part.

6. An enclosure as claimed in any one of claims 1 to 3, wherein the said second rotating means for rotating the first and second enclosure parts relative to one another comprise a toothed circular rack mounted on one part and a servo motor driving a toothed pinion engaged with the rack, the servo motor being mounted on the other part, and wherein a read-out device for indicating the relative rotational positions of the two enclosure parts has a toothed pinion engaged with the said rack to be driven thereby.

7. An enclosure as claimed in any one of claims 1 to 3, wherein means for mounting the gyro-stabilized mechanism within the enclosure interior consists of a pedestal, and wherein the said first rotating means comprise two separate motors, a first motor being connected between the pedestal and the mounting means for rotating them relative to one another and a second motor being connected between the enclosure and the pedestal for rotating them relative to one another, the said controlling means controlling the second rotating means and the said second motor of the first rotating means for the said compensation.

8. An enclosure as claimed in any one of claims 1 to 3, wherein means for mounting the gyro-stabilized mechanism within the enclosure interior consists of a pedestal having its central portion shaped to conform to the interior wall of the enclosure, and wherein the said first rotating means comprise two separate motors, a first motor being connected between the pedestal and the mounting means for rotating them relative to one another and a second motor being connected between the enclosure and the pedestal for rotating them relative to one another, the said controlling means controlling the second rotating means and the said second motor of the first rotating means for the said compensation.

9. An enclosure as claimed in any one of claims 1 to 3, wherein the window is constituted by an optically flat plate.

10. An enclosure as claimed in any one of claims 1 to 3, wherein the window is constituted by an optically flat plate shaped to the same radius of curvature as the enclosure.

11. An enclosure as claimed in any one of claims 1 to 3, wherein the window is transparent to infra-red radiation.

12. An enclosure as claimed in any one of claims 1 to 3, and including an antenna member mounted on the first enclosure part in fixed spatial relationship to the gyro-stabilized mechanism to reduce the possibility of interference between them.

* * * * *